US006916235B2

(12) United States Patent
Mikiya et al.

(10) Patent No.: US 6,916,235 B2
(45) Date of Patent: Jul. 12, 2005

(54) HAND-HELD ENDLESS BELT ABRADING MACHINE

(75) Inventors: Toshio Mikiya, Tokyo (JP); Takashi Chiba, Tokyo (JP); Atsushi Miura, Tokyo (JP); Keiichi Murakami, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 10/885,836

(22) Filed: Jul. 7, 2004

(65) Prior Publication Data

US 2005/0009457 A1 Jan. 13, 2005

(30) Foreign Application Priority Data

Jul. 8, 2003 (JP) ..... 2003-272050
Dec. 16, 2003 (JP) ..... 2003-417614

(51) Int. Cl.[7] ..... B24B 31/00
(52) U.S. Cl. ..... 451/296; 451/355
(58) Field of Search ..... 451/296, 344, 451/355, 356, 358, 489

(56) References Cited

U.S. PATENT DOCUMENTS 5,628,678 A * 5/1997 Tridico ..... 451/296
6,364,755 B1 * 4/2002 Sweek ..... 451/355
6,565,425 B1 * 5/2003 Wuensch ..... 451/309

FOREIGN PATENT DOCUMENTS

JP 2001-191242 A 7/2001

* cited by examiner

*Primary Examiner*—Jacob K. Ackun, Jr.
(74) *Attorney, Agent, or Firm*—Brinks Hofer Gilson & Lione

(57) ABSTRACT

A hand-held endless belt abrading machine comprises a base portion and a main portion, which portion is rotatable relative to the base portion around an axis extending in a forward and rearward direction of the abrading machine. The main portion comprises an air motor having a rotational shaft extending in a direction transverse to the abrading machine and projecting from the left end of the air motor, so that an abrading endless belt assembly drivingly connected to the output shaft is positioned to the left relative to the motor and the base portion which is held by a hand of an operator. When a left-handed person uses the abrading machine, the main portion is turned 180° relative to the base portion to shift the abrading endless belt assembly to the right relative to the base portion, thereby enabling the operator to readily observe the abrading belt assembly in operation.

14 Claims, 18 Drawing Sheets

HAND-HELD ENDLESS BELT ABRADING MACHINE

This application claims priority under 35 U.S.C. §119 to Japanese Patent Application Nos. 2003-272050 filed Jul. 8, 2003 and 2003-417614 filed Dec. 16, 2003, the entire contents of which are hereby incorporated by reference.

BACKGROUND

1. Field of the Invention

The present invention relates to an abrading machine and, in particular, to an endless belt abrading machine wherein an endless belt is rotatably driven and brought into contact with a workpiece to be abraded.

2. Description of the Related Art

In a conventional endless belt abrading machine, when an operator wishes to abrade a workpiece, s/he holds the machine with either a left or right hand, and brings the belt of the machine into contact with a workpiece to be abraded. Conventional endless belt abrading machines are provided with an air motor having a rotation shaft extending in a direction transverse to the machine; and are also provided with a drive pulley, which is drivingly connected to a left end of the rotation shaft; with a driven pulley positioned forward of and spaced apart from the drive pulley; and with an endless belt which is engaged with and extends between the drive and driven pulleys. During operation, an operator generally holds the machine using his/her right hand. Operating the machine in this manner, it is relatively easy for the operator to observe a workpiece being abraded, since the endless belt is positioned to the left of the operator's right hand which is holding the machine. However, in a case that an operator is left-handed and uses his/her left hand to hold the machine at its rear end, it is difficult for the operator to observe a workpiece being abraded since the belt abrading the workpiece is positioned to the left of the operator's left hand which is holding the machine. Consequently, it is difficult for a left-handed person to effectively operate the machine.

To solve the drawback of the conventional art, there has been proposed an endless belt abrading machine which is adapted to be used upside down, or to be used wherein a position of a holding portion of the machine is changed from a left to right side relative to an endless belt of the machine. (For example, refer to Japanese Patent Application No. 2002-220567). One of the features of the machine of the prior invention is that when the machine is operated with a holding portion being shifted from a right to a left side, a direction of the motor's rotation can be reversed, thus enabling the abrasion belt to be driven in the same direction as that in which an operator is facing. Consequently, sparks which are generated upon abrading a workpiece move in a direction away from the operator, thus enabling an abrasion operation to be easily and safely carried out.

In the machine of the prior invention, a ring valve is mounted on an outer surface of the machine, and functions as a valve controller for starting and stopping rotation of the machine's air motor. To achieve this function, however, the ring valve must be manually moved in either a forward or rearward direction by an operator, which requires use of both of the operator's hands. Moreover, if it is desired to set a holding portion from a right to a left side in the machine of the prior invention, the entire machine must be turned upside down. Consequently, in a case, for example, where an indicator showing a degree of load is mounted on an outer surface of the machine, setting a holding portion of the machine from a right to a left side results in a drawback that the indicator is visually obscured.

SUMMARY OF THE INVENTION

In view of the above-described drawbacks of the conventional art, an object of the present invention is to provide a hand-held endless belt abrading machine, which includes a main portion, and also a base portion, which portion is connected to a rear of the main portion. The main portion has an air motor which has an axis of rotation which acts in a direction transverse to the machine; a drive pulley which is drivingly connected to an output shaft, which extends in a lateral direction from one end of the air motor; a driven pulley which is positioned forward of and spaced apart from the driven pulley; and an endless belt which is engaged with and extends between the drive pulley and the driven pulley. In addition, the main portion is pivotable about an axis which extends longitudinally from the base portion between a first operational position, where the output shaft of the air motor is extended to the left, and a second operational position, where the output shaft is extended to the right. The base portion has a first air passageway, which is connected to a source of compressed air for supplying compressed air to the main portion to drive the air motor; a stop valve which is adapted to open and close the first air passageway; and a valve controller for operating the stop valve.

In the abrading machine of the present invention, the endless abrading belt can be set to be on either a right side or a left side relative to the main portion of the machine. This is accomplished by simply rotating the main portion of the machine while keeping the base portion of the machine in a fixed position. Consequently, a stop valve controller mounted on the base portion remains in a fixed position relative to a position of the operator thus enabling an operator to readily operate the valve controller, while selectively positioning the abrasive endless belt at either the right or the left side, depending on a convenience of observation of an operator.

The stop valve controller may be movable between a depressed position and a position in which it is not depressed, to thereby enable the stop valve to be opened and closed.

The air motor may also have first and second openings to be selectively supplied with compressed air depending on whether it is desired to rotate the machine's air motor in either a forward or in a reverse direction. The main portion may also have a second air passageway including a common passage having an air inlet, which communicates with the first air passageway of the base portion, and first and second branched passage respectively extending to the first and second openings of the air motor.

On an outer surface of the main portion of the machine, there may be provided a ring valve, which is movable between a first position and a second position. When the ring valve is located in the first position, the common passage is brought into communication with the first branched passage; and when the ring valve is located in the second position, the common passage is brought into communication with the second branched passage.

The main portion of the machine may have a columnar portion extending in the forward and rearward direction and having a circular cross-section. The columnar portion is provided with the second air passageway. Specifically, the common passage extends from the air inlet to an air outlet opening at the outer surface of the columnar portion. The first branched passage extends from a first inlet/outlet opening formed in the outer circumferential surface at a position circumferentially spaced apart from the air outlet to the first opening of the air motor. The second branched passage extends from a second inlet/outlet opening formed in the same surface at a position circumferentially spaced apart from the air outlet and the first inlet/outlet opening to the second opening of the air motor.

The ring valve may be mounted on the outer circumferential surface of the columnar portion and is rotatable between a first position where the air outlet is communicated with the first inlet/outlet opening and a second position where the air outlet is communicated with the second inlet/outlet opening.

In accordance with another aspect of the present invention, there is provided a hand-held endless belt abrading machine comprising: a main portion including an air motor having a rotational shaft extending in a direction transverse to the abrading machine and projecting from one lateral end of the air motor, the air motor further having first and second openings and being adapted to be selectively supplied with compressed air through either the first opening or the second opening depending on whether it is desired to rotate the motor in a forward or rearward direction, a drive pulley drivingly connected to a tip end of the output shaft of the air motor, a driven pulley positioned forward of and spaced apart from the drive pulley, and an abrading endless belt engaged with and extending between the drive and driven pulleys; and a base portion connected to a rear of the main portion and including: an air inlet passage for supplying compressed air to the air motor, an air outlet passage for discharging air exhausted from the air motor to the outside of the machine, a stop valve for opening and closing the air inlet passage, the stop valve having an outer end projecting outside the base portion, and a lever for operating the stop valve, the lever being pivotably mounted on the base portion to move between an opening position where the stop valve opens the air inlet passage, and a closing position where the stop valve closes the air inlet passage.

When the main portion is located in the first operational position, the air inlet passage of the base portion is communicated with the first opening, while the air outlet passage is simultaneously communicated with the second opening of the motor; and when the main portion is located in the second operational position, the air inlet passage is communicated with the second opening, while the air outlet passage is simultaneously communicated with the first opening. The main portion includes a sleeve mounted thereon so as to be movable in a longitudinal direction of the main portion between a rotation-prevention position, where the sleeve is engaged with the base portion to prevent the main portion from rotating relative to the base portion, and a rotation-enabling position where the sleeve is disengaged from the base portion to permit the main portion to rotate relative to the base portion.

The main portion may include a rearward facing surface which faces the base portion and forms a right angle with an axis extending in the forward and rearward direction, and first and second air passages opening which are positioned to be diametrically opposite each other on a circle on the rearward facing surface centering around an axis extending in the forward and rearward direction through the base portion. The first and second air passages are communicated with the first opening and the second opening of the motor, respectively. The air inlet passage of the base portion may include a larger diameter portion and a smaller diameter portion, arranged in that order, from a front end thereof adjacent to the rearward facing surface of the main portion. The larger diameter portion is provided with a cylindrical seal movable in the forward and rearward direction, and with a coil spring which urges the cylindrical seal against the rearward facing surface. The cylindrical seal has a front end slidably and hermetically engageable with the rearward facing surface of the main portion. When the main portion is located in the first operational position, the cylindrical seal is communicated with the first air passage; and when the main portion is in the second operational position, the cylindrical seal is communicated with the second air passage.

The lock sleeve may include a notch which is formed in a rear end periphery thereof such that, when the sleeve is located in the rotation-prevention position, the notch engages with a pin secured on an outer circumferential surface of the base portion to prevent the main portion from rotating relative to the base portion.

The base portion may comprise an outer cylindrical portion and an inner cylindrical portion disposed in the outer cylindrical portion which extends in the forward and rearward direction of the machine. The inner cylindrical portion has a longitudinal hole which forms the air inlet passage. A space extending in a longitudinal direction of the inner and outer cylindrical portions is formed between an outer surface of the inner cylindrical portion and an inner surface of the outer cylindrical portion, the space functioning as the air outlet passage.

The inner cylindrical portion of the base portion may have a forward end extending beyond a front end of the outer cylindrical portion of the base portion. The main portion may include a cylindrical joint, which extends rearward to hermetically receive the forward end of the base portion such that the base portion is rotatable about a longitudinal axis thereof while maintaining an air-tight state between the cylindrical joint and the forward end of the base portion, and a columnar portion which has the first and second air passages, and is positioned inside and extends rearward of the main portion member terminating at the rearward facing surface. An air outlet passage is formed between an inner surface of the cylindrical joint of the main portion and the outer surface of the columnar portion of the main portion, the air outlet passage extending from the air motor.

The cylindrical joint of the main member has an inner surface provided with a pair of stop portions which are adapted to be engaged with the forward end of the cylindrical portion defining the air inlet passage to position the main portion at the first and second operational positions, respectively.

The above and other objects, features and advantages of the present invention will become more apparent from the following description of the preferred embodiments thereof, taken in conjunction with the accompanying drawings.

DESCRIPTION OF THE PREFERRED EMBODIMENTS

An embodiment of the endless belt abrading machine according to the present invention will now be described below with reference to the accompanying drawings.

Figure 1:
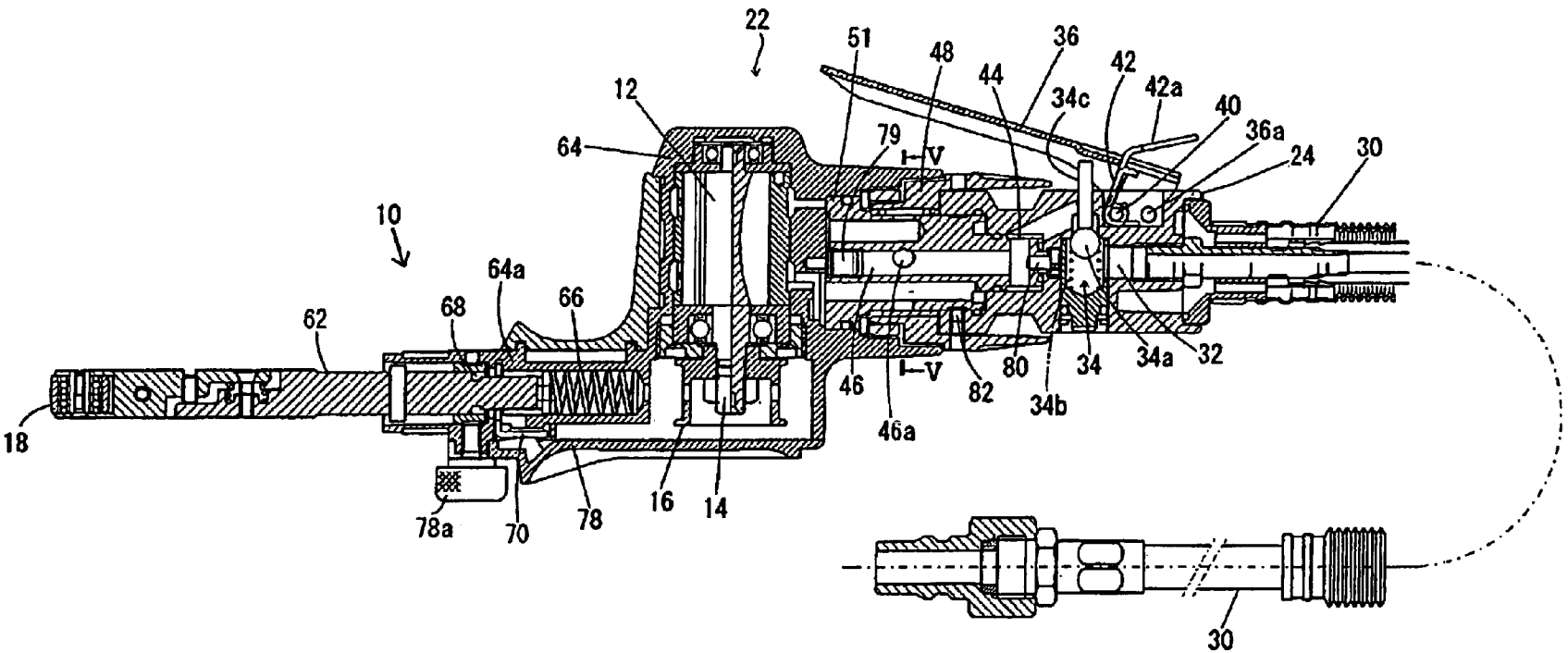
FIG. 1 is a sectional plan view of an endless belt abrading machine of the first embodiment of the present invention.
Figure 2A:
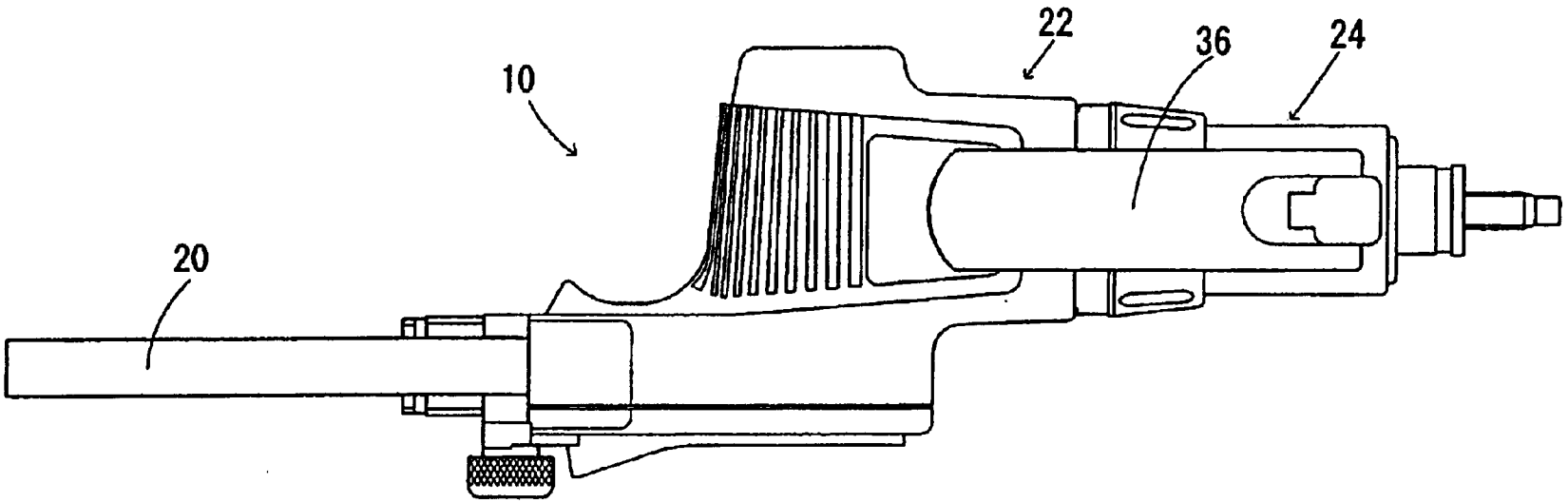
FIG. 2*a* is a plan view of the endless belt abrading machine in a state where a belt is in its initial position.
Figure 2B:
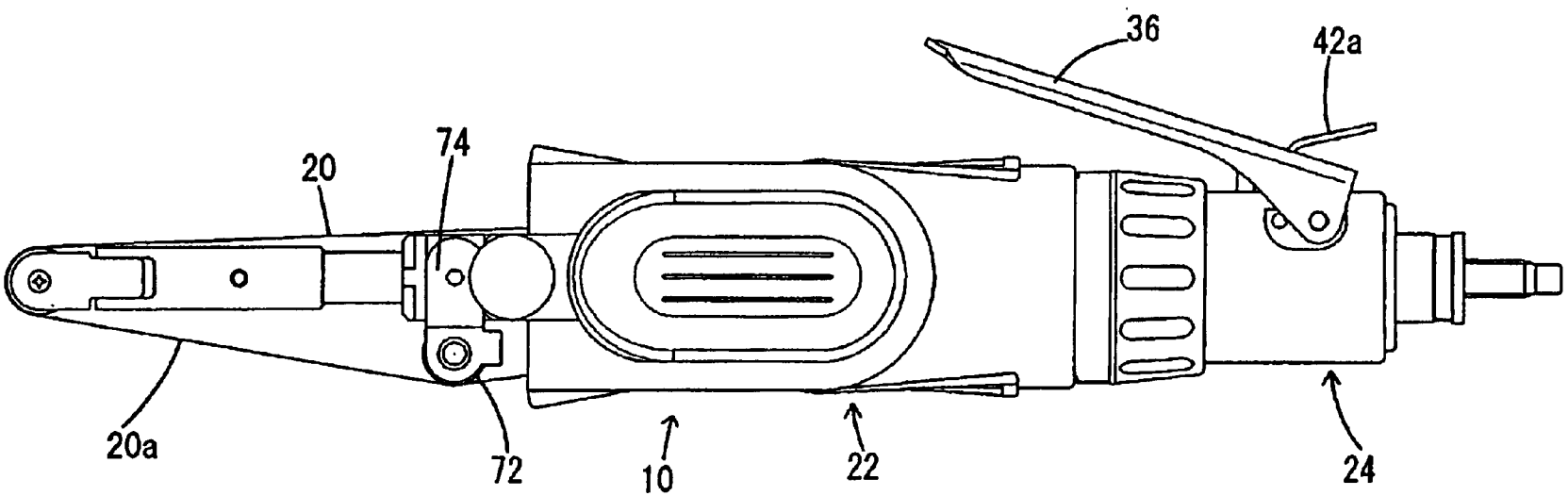
FIG. 2*b* is a left side view of FIG. 2*a*.

FIG. 1 is a sectional plan view of the endless belt abrading machine of the present invention. To clearly illustrate the structure of the abrading machine of the present invention, in FIG. 1, a base portion of the abrading machine 24 (which will be described hereinafter) is shown in a position rotated by 90° relative to a usual position of the machine's main portion 22, as viewed along the machine's longitudinal axis from left to right. FIG. 2 is a plan view of the machine in which the machine's base portion 24 is shown in its usual operation. FIG. 2*b* is a side view of the machine.

The machine 10 has the main portion 22 and the base portion 24. The main portion 22 includes: an air motor 12 having an axis of rotation which is transverse to the machine 10; a drive pulley 16 which is drivingly connected to an output shaft 14, and which extends laterally from one end of the air motor; a driven pulley 18, which is positioned forward of the drive pulley 16; and an endless belt 20 (shown in FIG. 2*a*, FIG. 2*b*), which is engaged with each of the drive and driven pulleys 16, 18.

The base portion 24 includes a first air passageway 32 connected to a hose 30 extending from a source of compressed air (a pump) for supplying compressed air to the main portion 22 to drive the air motor 12, a valve 34 for opening or closing the first air passageway 32, and a lever 36 pivotably fitted on a circumferential top area of the base portion 24. The lever 36 is movable between a depressed position and a released position, so as to enable the valve 34 to open or close the first air passageway 32. In the illustrated example, the first air passageway 32 has an axial portion, a radial portion and a slanting portion. The axial portion extends parallel to an axis of the base portion from a joint opening, which is located at a rear end of the base portion and is connected to the hose 30. The radial portion extends radially from the front end of the axial portion. The slanting portion extends forward and radially inward from the radial portion. The stop valve 34 has a valve member (a ball) 34*a* set in the radial portion of the first air passageway 32, and a spring 34*b* which urges the valve member 34*a* against a valve seat formed on the inner surface of the radial portion of the first air passageway 32. The lever 36, which is pivotable about a pivot pin 36*a*, is retained in the released position, as shown in FIG. 1, by way of a lever retainer 42, which is rotatable about a pivot pin 40 positioned forward of the pivot pin 36*a*, and which is urged by a spring to engage with a lower surface of the lever 36. The lever retainer 42 has an extending portion 42*a* extending upwards of the lever 36. When the extending portion 42*a* of lever retainer 42 is moved downwards in a clockwise direction about the pivot pin 40 (against the action of the spring 34*b*), the lever retainer 42 is rotated clockwise, which enables the lever 36 to be moved downwards counterclockwise about the pivot pin lever 36*a*. When the extending portion of lever retainer 42*a* is enabled to move upwards again, the lever retainer 42 and the lever 36 are sprung back into the position, as shown in FIG. 1, under the action of the spring 34*b*. Further, there is provided a connecting rod 34*c* extending vertically between the underside of the lever 36 and the valve member 34*a*. When the lever 36 is depressed or released, the connecting rod 34*c* acts on the valve member 34*a* to cause it to be either seated in or separated from the valve seat, and to thereby either open or close the stop valve 34.

Figure 3A:
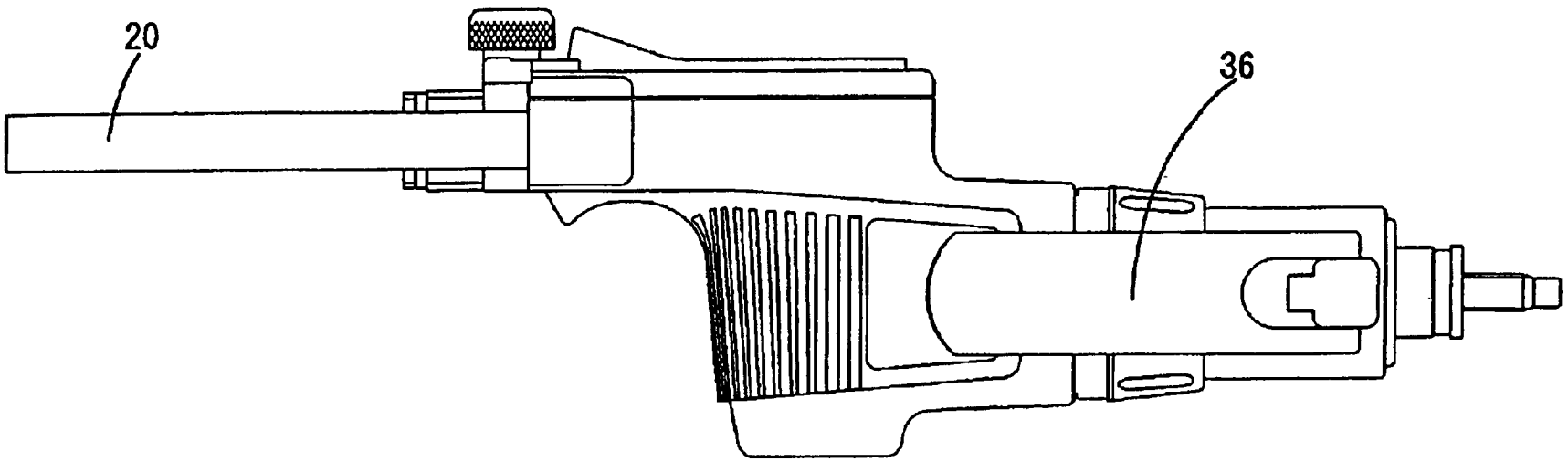
FIG. 3*a* is a plan view of the endless belt abrading machine in a state where the belt is located at a side opposite to that shown in FIG. 2*a*.

Hereinafter, the main portion 22 will be described in more detail. The portion 22 is adapted to be rotated about a longitudinal axis of the base portion of the machine 24 to a first operational position, where the output shaft 14 of the motor extends to the left of the machine (FIG. 1, FIG. 2*a*), and can also be rotated to a second operational position, where the output shaft 14 extends to the right of the machine(FIG. 3*a*).

Figure 4:
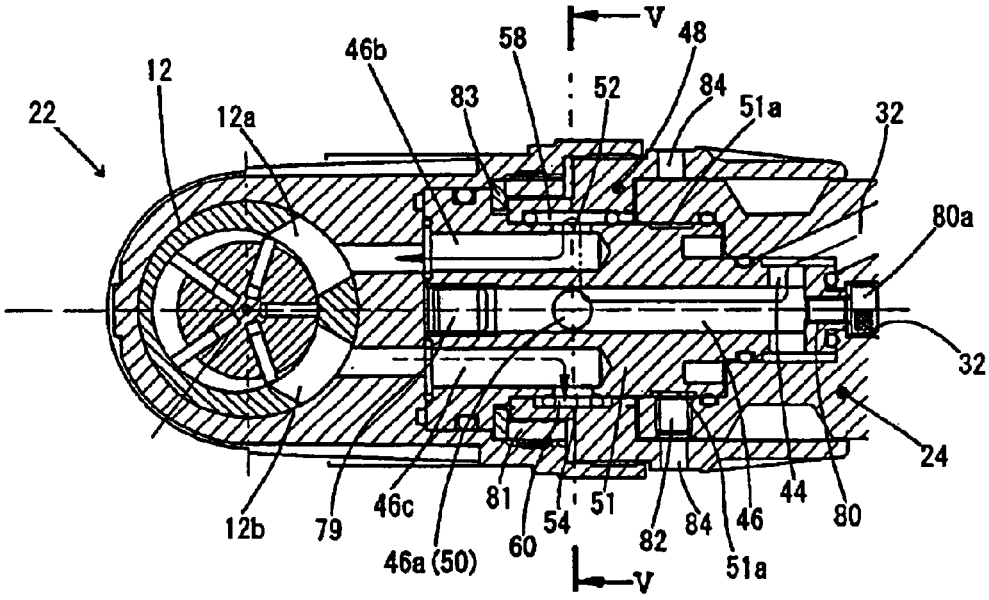
FIG. 4 is a transverse sectional view of an air motor of the endless belt abrading machine showing the positional relation of the air passages to the air motor.

The air motor 12 is a vane motor, as shown in FIG. 4, and has first and second openings 12*a*, 12*b*; and is selectively supplied with compressed air through either the first opening 12*a* or the second opening 12*b* to be caused to rotate in either a forward or reverse direction.

As shown in FIG. 4, the main portion 22 includes a second air passageway 46 which has a fluid passage extending from an air inlet 44 connected with the slanting portion of the first air passageway 32 of the base portion 24 to the first or the second opening 12*a*, 12*b* of the air motor. There is further provided a ring valve 48, which controls an air flow through the second air passageway 46 on an outer surface of the main portion 22. The ring valve 48 is rotatable between a first and the second position. As will be described later, when the ring valve 48 is in the first position, the air inlet 44 of the second air passageway 32 is adapted to communicate with the first opening 12*a* of the air motor; and when the ring valve 48 is in the second position, the air inlet 44 of the second air passageway 32 is adapted to communicate with the second opening 12*b* of the air motor.

Figure 5A:
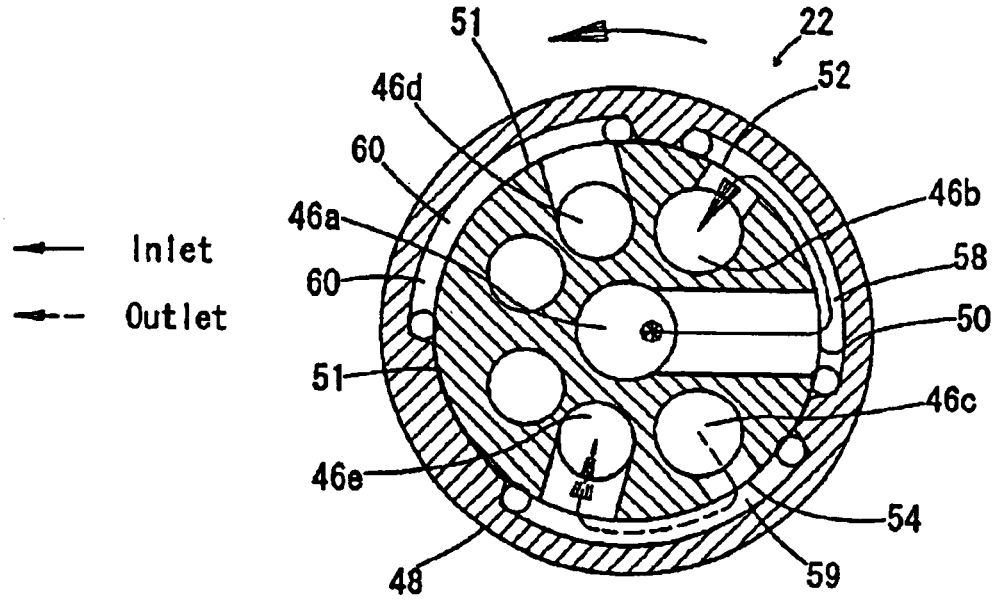
FIG. 5*a* is a sectional view taken along line V—V of FIG. 1 and FIG. 4 wherein the ring valve is positioned such that the air motor rotates in its normal direction.
Figure 5B:
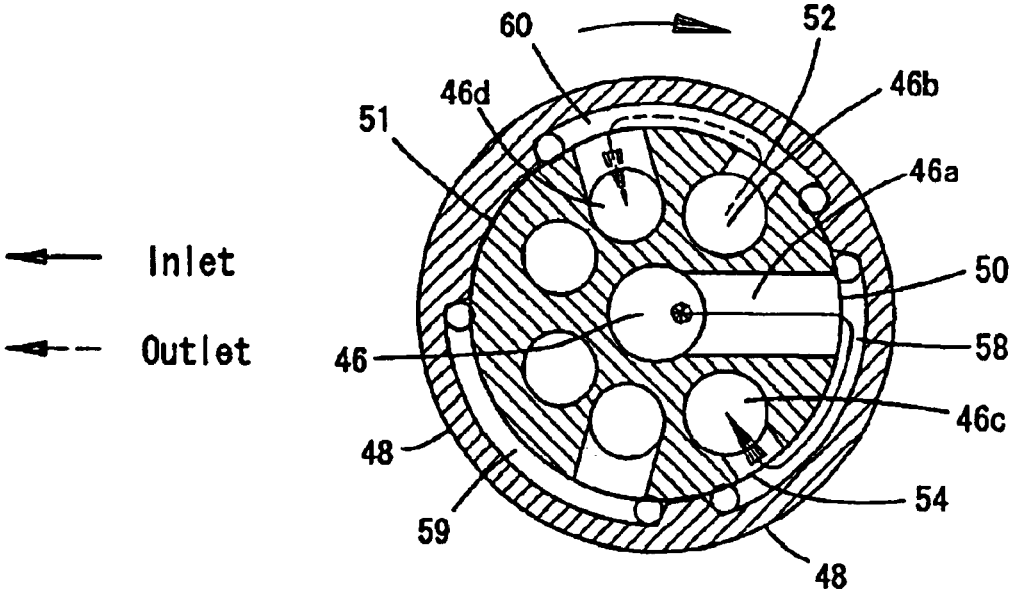
FIG. 5*b* is a sectional view taken along line V—V of FIG. 1 and FIG. 4 wherein the ring valve is positioned such that the air motor rotates in a reverse direction.

More specifically, as shown in FIGS. 4, 5*a* and 5*b*, the main portion 22 includes a columnar portion 51 having a circular cross-section and defines the second air passageway 46. The columnar portion 51 has a common passage 46*a* (FIGS. 5*a* and 5*b*), a first branched passage 46*b* (FIGS. 5*a* and 5*b*, FIG. 4) and a second branched passage 46*c* (FIGS. 5*a* and 5*b*, FIG. 4). The common passage 46*a* extends from the air inlet 44 (FIG. 1) to an air outlet 50 opening at an outer surface of the columnar portion 51. The first branched passage 46*b* (FIGS. 5*a* and 5*b*, FIG. 4) extends from a first inlet/outlet opening 52 which is provided on the outer surface of the columnar portion 51 circumferentially spaced apart from the air outlet 50, to the first opening 12*a* of the air motor. The second branched passage 46*c* (FIG. 5*a*, FIG. 4) extends from a second inlet/outlet opening 54, which is provided on the outer surface of the columnar portion 51 circumferentially and in symmetrical relation to the first inlet/outlet opening 52 about the air outlet 50, to the second opening 12*b* of the air motor.

The ring valve 48 is provided with arcuate recesses 58, 59, 60 on an inner surface thereof. When the ring valve 48 is in the first position (FIG. 5*a*, FIG. 4), the arcuate recess 58 connects the air outlet 50 and the first inlet/outlet opening 52 to allow flow to flow to the air motor; and the arcuate recess 59 connects the second inlet/outlet opening 54 to an exhaust passage 46*e* formed in the columnar portion to allow exhaust to flow from the air motor, under which condition the air motor rotates. When the ring valve 48 is in the second position (FIG. 5*b*), the arcuate recess 58 connects the air outlet 50 and the second inlet/outlet opening 54 to allow air to flow to the air motor; the arcuate recess 60 connects the first inlet/outlet opening to the exhaust passage 46*d* in the columnar portion to allow exhaust from the air motor, under which condition the air motor rotates in a reverse direction.

Figure 3B:
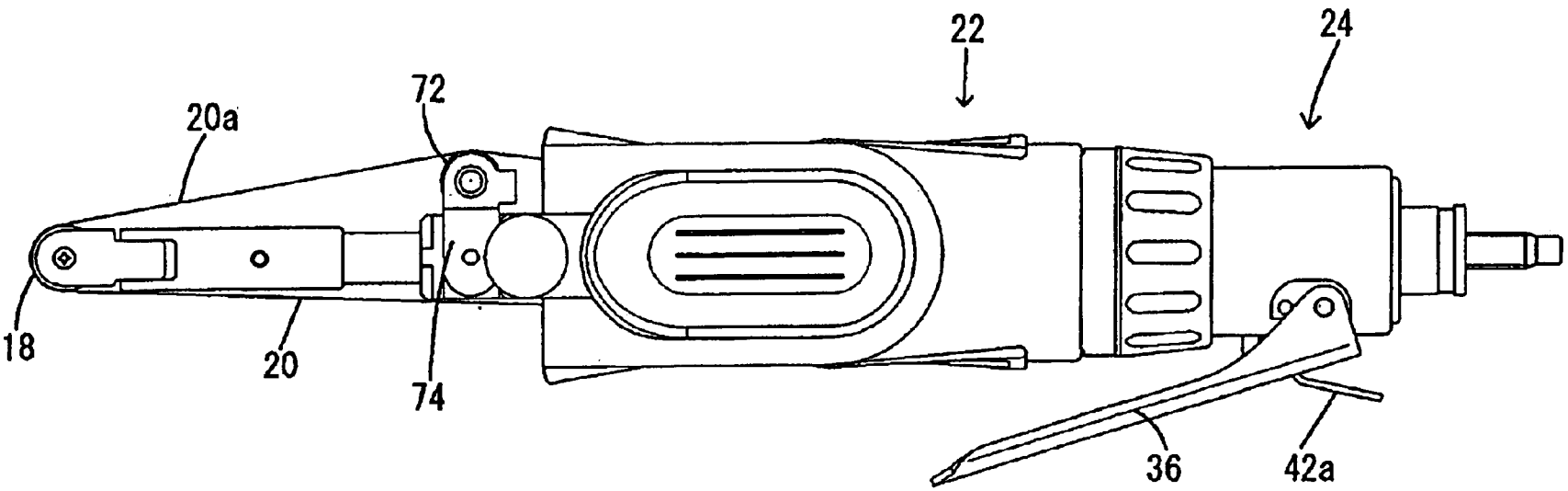
FIG. 3*b* is a right side view of FIG. 3*a*.

The driven pulley 18 is rotatably mounted on a distal end of a tension bar 62 in the same manner as in the abovementioned invention (Japanese Patent Application No. 2002-220567). The rear end portion of the tension bar is inserted into a cylindrical portion 64*a* which extends forward from a housing 64 of the air motor 12, and is urged forward by a compression spring 66 provided in the cylindrical portion 64*a*. In this way, tension is applied to the endless belt 20 which is engaged with both the driven pulley 18 and the drive pulley 16. An annular groove 68 is formed on a peripheral surface of the tension bar 62. When it is required to replace a belt, the tension bar 62 is inserted into the cylindrical portion 64*a* against the action of the compression spring 66, which permits a spring 70 to engage in the annular groove 68 and to retain the tension bar 62. After replacement of the belt, when the spring 70 is disengaged from the annular groove 68, the tension bar is returned to its previous state under the action of the compression spring 66. In FIG. 2*b*, the reference numeral 72 denotes a pulley. For the purpose of forming an abutting portion 20*a* on the endless belt 20 for a workpiece, the pulley 72 is engaged with the endless belt 20. Also, the pulley 72 is supported by a bracket 74, which is mounted on the tension bar 62 to project downwardly. The bracket 74 is detachable from the tension bar 62. In a case where the main portion is reversed between the first position shown in FIG. 2 and the second position shown in FIG. 3 (upside down as seen in those figures.), the bracket 74 is detached from an initial position on tension bar 62 to be next attached at a longitudinal opposite position from the initial position on the tension bar 62 so that the pulley 72 supported by the bracket always remains set beneath the tension bar 62. In FIG. 1, the numeral 78 denotes a cover which is detachably mounted on the cylindrical portion 64*a* by a screw 78*a*.

Figure 6:
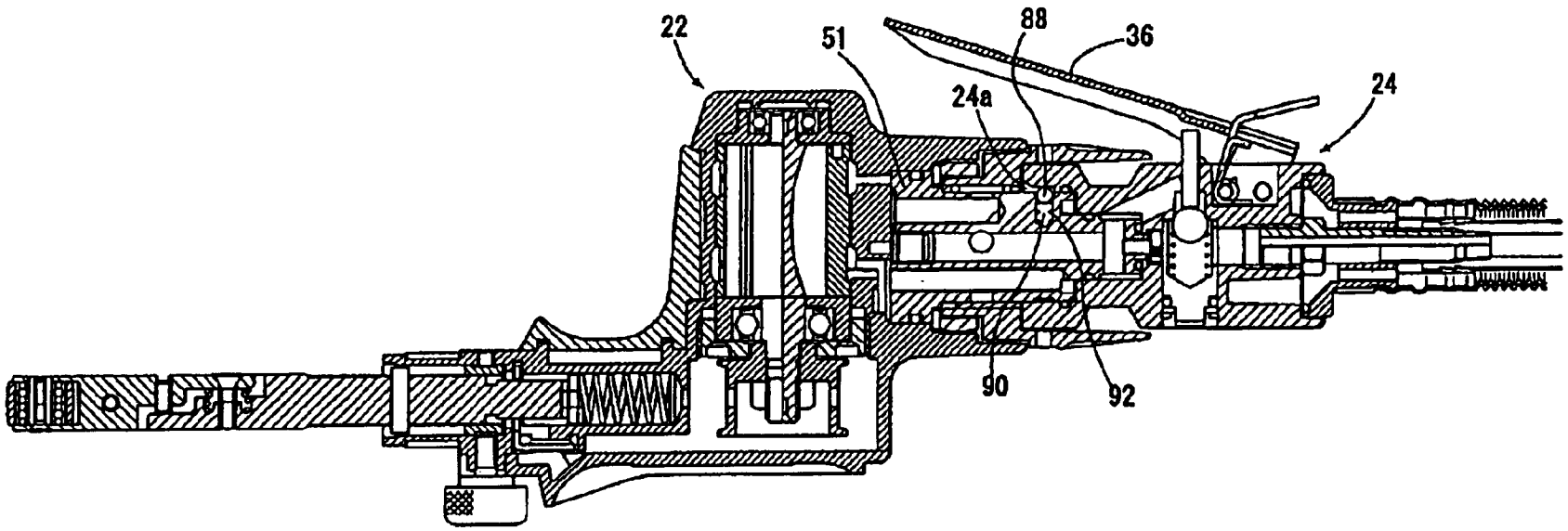
FIG. 6 is a sectional plan view of the endless belt abrading machine of another embodiment of the present invention.

As stated, the main portion includes the housing 64 of the air motor, the columnar portion 51 fixed to the rear of the housing, the ring valve 48 rotatably mounted around the outer surface of the columnar portion, and the tension bar 62 mounted on and extending toward from the side of the housing 64 of the air motor, and is rotatable around the longitudinal axis of the cylindrical base portion. As is clearly shown in FIG. 1 and in FIG. 4, the columnar portion 51 is fixedly connected to the housing 64 by a lock nut 81 threaded into the housing 64 of the air motor 12 through a washer 83. A rear half of the columnar portion 51 is inserted into the cylindrical base portion 24 coaxially, and is held rotatably about the central axis of the base portion 24. Further, the columnar portion 51 is provided with a through hole which extends from the rear end to the front end of the columnar portion. The rear and front ends of the through hole are blocked by blocking members 79, 80 which are threadably engaged thereinto, to form the second air passageway 46 between the blocking members. The blocking member 80 engaged with the rear end has a bolt-like form, and has a head portion 80*a*, which is positioned in and engaged with the first air passageway 32 to prevent the columnar portion 51 from moving out of the main portion 24. In FIG. 4, the reference numeral 82 denotes a hexagonal socket head cap screw. The screw 82 is threadingly engaged with a threaded bore formed radially through the base portion 24, and is engaged in recess 51*a* formed on the outer surface of the columnar portion 51, which results in prevention of the columnar portion 51, and hence the main portion 22, from rotating relative to the base portion 24. The recesses 51*a*, 51*a* are arranged in a pair, with each recess being provided on the columnar portion in diametrically opposed positions relative to one another. When the main portion is in the abovementioned first position (shown in FIG. 2*a*) or in the second position (shown in FIG. 3*a*), the screw 82 is engaged with a corresponding one of the recesses 51*a* to fix the main portion to the base portion. The numeral 84 denotes a through-hole provided in the ring valve 48 for insertion of an Allen key for turning the hexagonal socket head cap screw. Referring to FIG. 6, there is shown another embodiment of the present invention in which a ball 88 is used instead of the screw 82. Specifically, in this embodiment, there is provided a bore 90 which extends radially in the columnar portion 51 of the main portion 22 and opens at the outer surface thereof. The ball 88 is set in the bore 90 and is urged radially outwardly by a spring 92 set in the bore 90. Further, the ball 88 is engaged in recesses formed at a circumferentially predetermined position on an inner surface of the base portion 24 surrounding the columnar portion 51, to prevent the columnar portion 51, and hence the main portion 22, form rotating relative to the base portion 24. The recesses are arranged in a pair, with each recess being provided on the base portion 24 in diametrically opposed positions relative to one another. When the main portion is in the abovementioned first position (shown in FIG. 6) or in the second position (the reversed position of the main portion shown in FIG. 6 relative to the base portion), the ball 88 is engaged with a corresponding one of the recesses to fix the main portion to the base portion .

Figure 7:
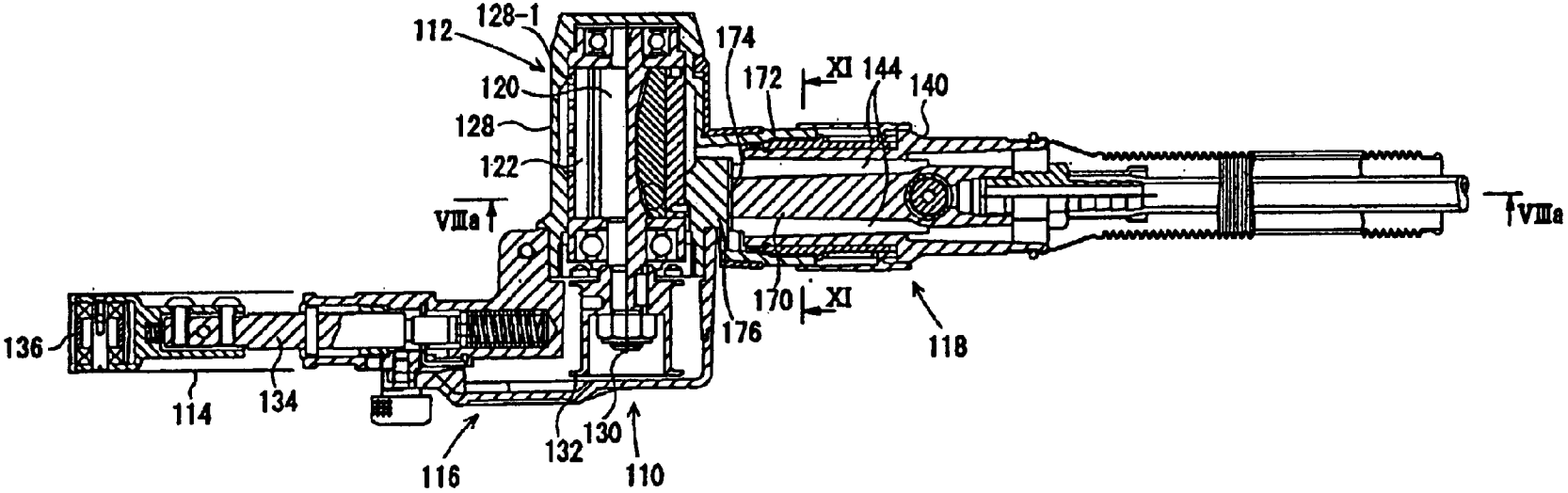
FIG. 7 is a sectional plan view of the endless belt abrading machine of the second embodiment of the present invention.

Next, a second embodiment of the endless belt abrading machine according to the present invention will be described with reference to the accompanying drawings. FIG. 7 is a sectional plan view of the endless belt abrading machine of the present invention. FIG. 8 is a sectional view taken along line VIIIa—VIIIa of the FIG. 7.

This endless belt abrading machine 110 has a main portion 116 and a base portion 118. The main portion 116 includes an air motor 112 and an endless belt 114 driven by the air motor 112. The base portion 118 is connected to a rear part of the main portion 116 in order to supply and exhaust compressed air for the air motor 112.

The air motor 112 is a vane-type motor and has a rotor 120 rotatable about an axis extending transversely of the machine 110, a rotor chamber 122 for accommodating the rotor, and a rotor housing 128 including a first and a second air passage 124, 126 for supplying and exhausting compressed air to and from the rotor chamber 122. In the illustrated example, the rotor housing 128 has a cylindrical liner portion 128-1 provided on the interior surface, and has first and second openings 124-1, 126-1 which respectively interconnect with the first and second air passage 124, 126. The endless abrading belt 114 is engaged with the drive pulley 132, which is drivingly connected to an output shaft 130 which extends laterally from one end of the air motor 112; with the driven pulley 136 being positioned forward of the drive pulley 132 by a tension bar 134.

Figure 8A:
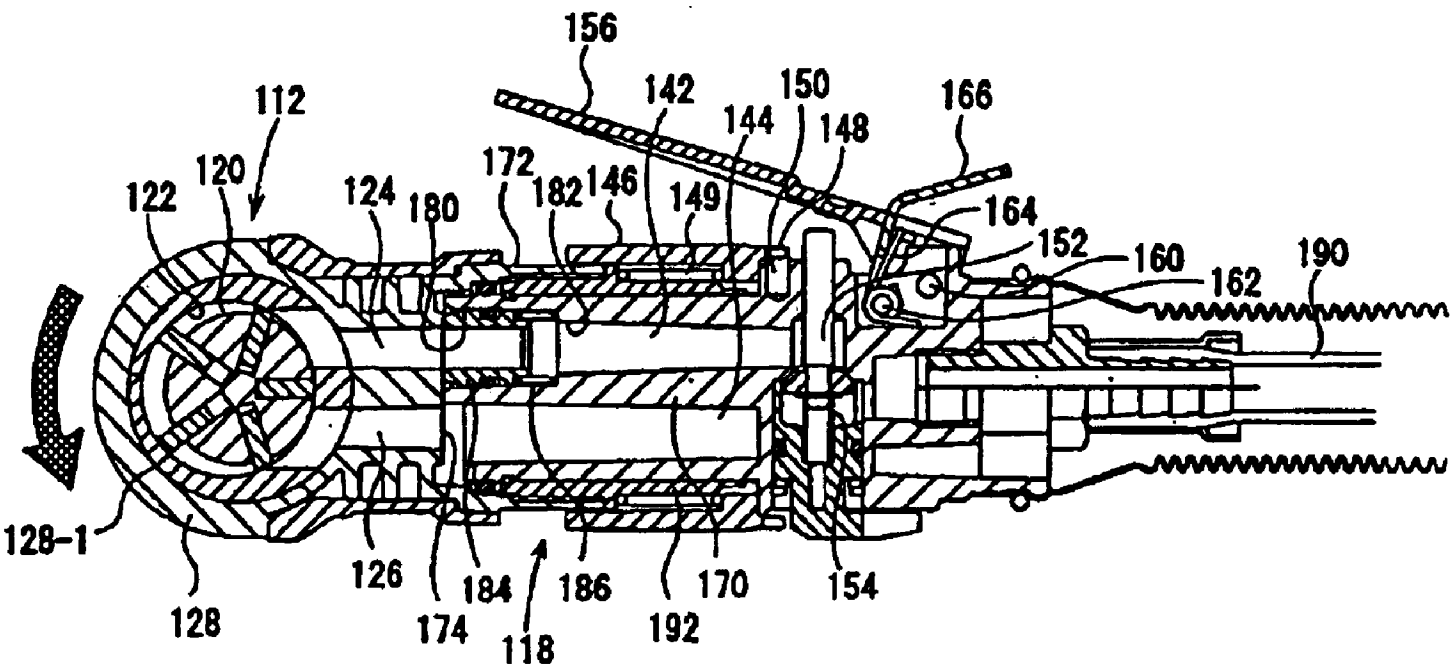
FIG. 8*a* is a sectional view taken along line VIIIa—VIIIa of FIG. 7.
Figure 8B:
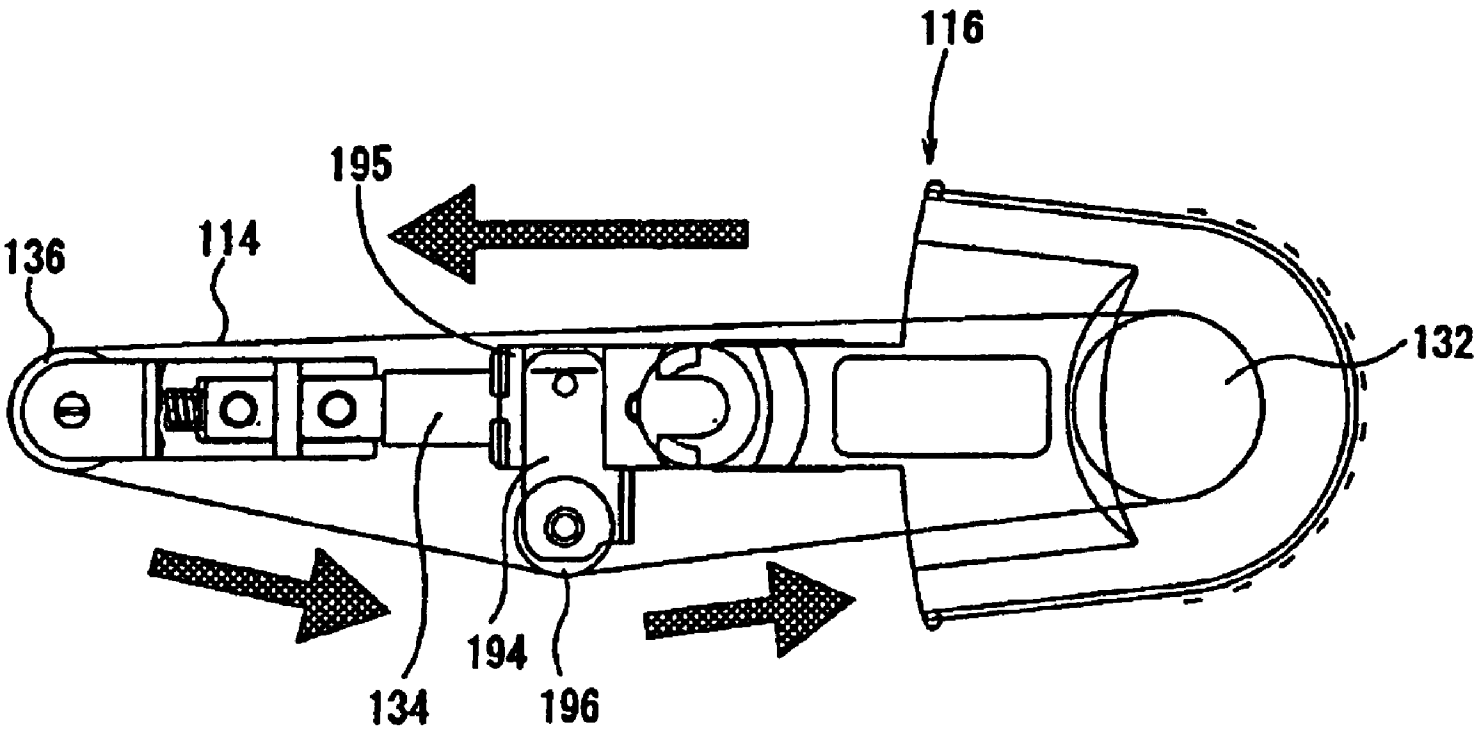
FIG. 8*b* is a side view of a main portion of the machine showing a direction of rotation of the belt when a basic portion of the machine and the main portion have the relation shown in FIG. 8*a*.
Figure 9A:
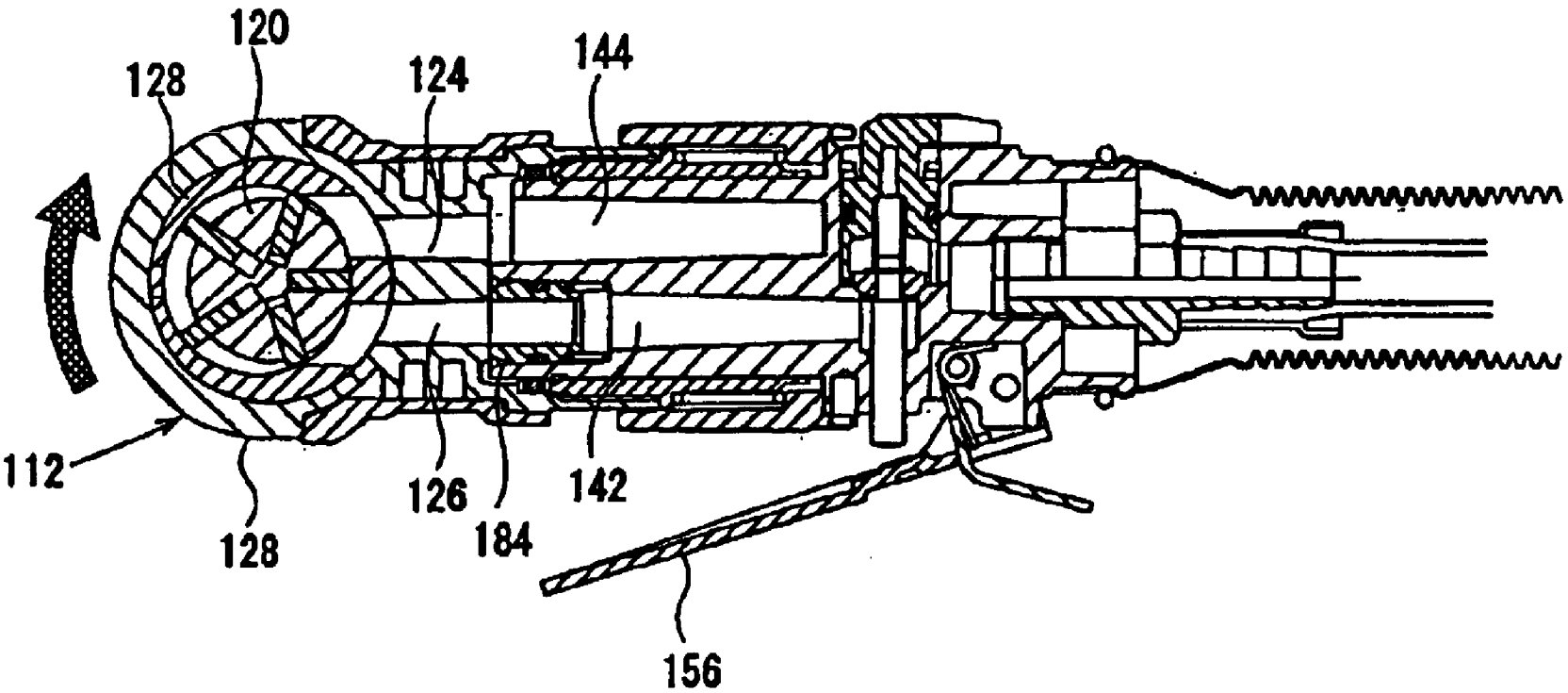
FIG. 9*a* is a sectional view taken along line VIIIa—VIIIa of FIG. 7 showing a state where the basic portion of the machine has been rotated 180° relative to the main portion of the machine, as viewed from the position shown in FIG. 8*a*.
Figure 9B:
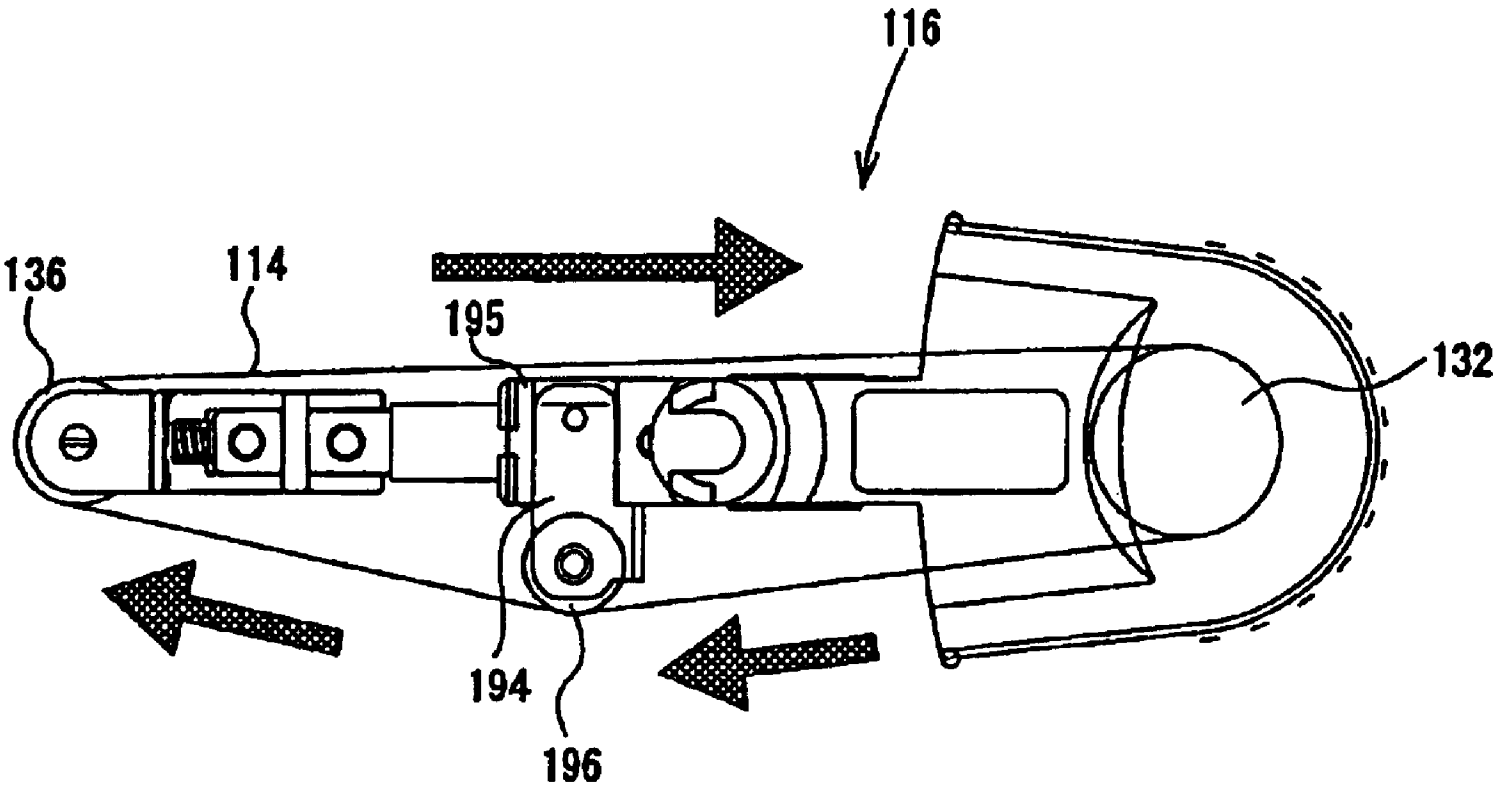
FIG. 9*b* is a side view of the main portion of the machine showing a direction of rotation of the belt when the basic portion and the main portion of the machine have the relation shown in FIG. 9*a*.

The base portion 118 has a base portion member 140 which is rotatably connected with a rear portion of the rotor housing 128 of the air motor 112 about an axis extending forward and rearward. The base portion member 140 has an air inlet passage 142 and an air outlet passage 144, and is rotatably mounted between the first position and the second position. In the first position (FIG. 8*a*), the air inlet passage 142 is adapted to communicate with the first air passage 124 and the air outlet passage 144 is adapted to communicate with the second air passage 126. In the second position (FIG. 9*a*) where the base portion 118 has been turned 180° from the first position, the air inlet passage 142 is adapted to communicate with the second air passage 126, and the air outlet passage 144 is adapted to communicate with the first air passage 124. When the base portion member 140 is in the first position, as shown in FIG. 8*a* and FIG. 8*b*, the rotor 120 and the belt 114 are turned counterclockwise, as indicated by the arrows in those figures. When the base portion member 140 is in the second position, as shown in FIG. 9*a* and FIG. 9*b*, the rotor 120 and the belt 114 are turned clockwise as indicated by arrows in those figures.

Figure 10:
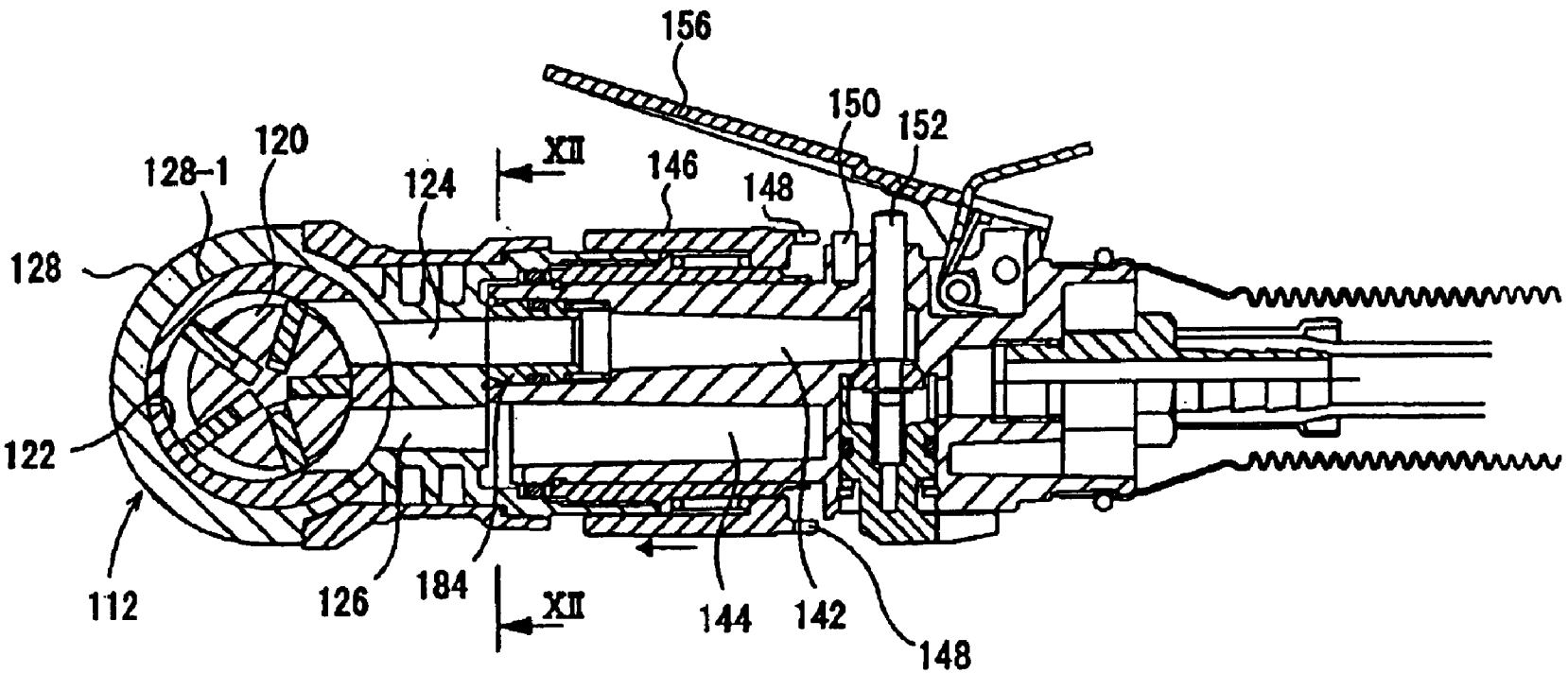
FIG. 10 is a sectional view similar to that shown in FIG. 8*a*, but where a lock sleeve has been moved forwards.

On an outer periphery surface of the base portion member 140, there are provided a lock sleeve 146, which is movable only forward and rearward relative to the rotor housing 128, and a coil spring 149 which urges the lock sleeve 146 rearward. The lock sleeve 146 is formed with a notch on a periphery of its rear end for fitting a pin 150 to be fixedly mounted to the base portion, and to be movable between a rotation-restraining position (FIG. 7, FIG. 8) and a rotation-enabling position (FIG. 10). In the rotation-restraining position (FIG. 7, FIG. 8), the lock sleeve 146 fits the pin 150, which prevents the base portion member 140 from turning relative to the rotor housing 128. In the rotation-enabling position (FIG. 10), the lock sleeve 146 is moved forward from where the lock sleeve is in the holding position and is released by the pin 150, which allows the base portion member 140 to rotate relative to the rotor housing 128. Further, there is provided a rod-like poppet valve 152 in the base portion member 140, for closing and opening the air inlet passage 142. The poppet valve 152 is urged by the coil spring 154 to a position for closing the air inlet passage 142 (FIG. 8*a*) and an upper end thereof extends outside of the base portion member 140. Further, there is provided a lever 156 in the base portion member 140. The lever 156 is rotatably fitted on the base portion member 140 to be moved between an opening position (depressed position) where the lever 156 is adapted to depress the valve 152 to open the air inlet passage 142, and a closing position (undepressed position) where the coil spring 154 allows the valve 152 to return to the position to close the air inlet passage 142.

The lever 156 with a lever pivot pin 160 is retained in a released position shown in FIG. 8*a* by a lever retainer 164, which is pivotably mounted on a pivot pin 162 positioned forward of the lever pivot pin 160; and the lever retainer is urged under the action of a spring to be engaged with an under surface of the lever 156. The lever retainer 164 has an extending portion 166 which extends upward of the lever 156. When the extending portion 166 of the lever retainer 166 is moved down clockwise about the pivot pin 162 (against the action of the spring), the lever retainer 164 is rotated clockwise, which enables the lever 156 to be moved down counterclockwise about the pivot pin of lever 160. When the extending portion of lever retainer 166 is released, the lever retainer 164 and the lever 156 are sprung back into the position shown in FIG. 8*a*.

Figure 11:
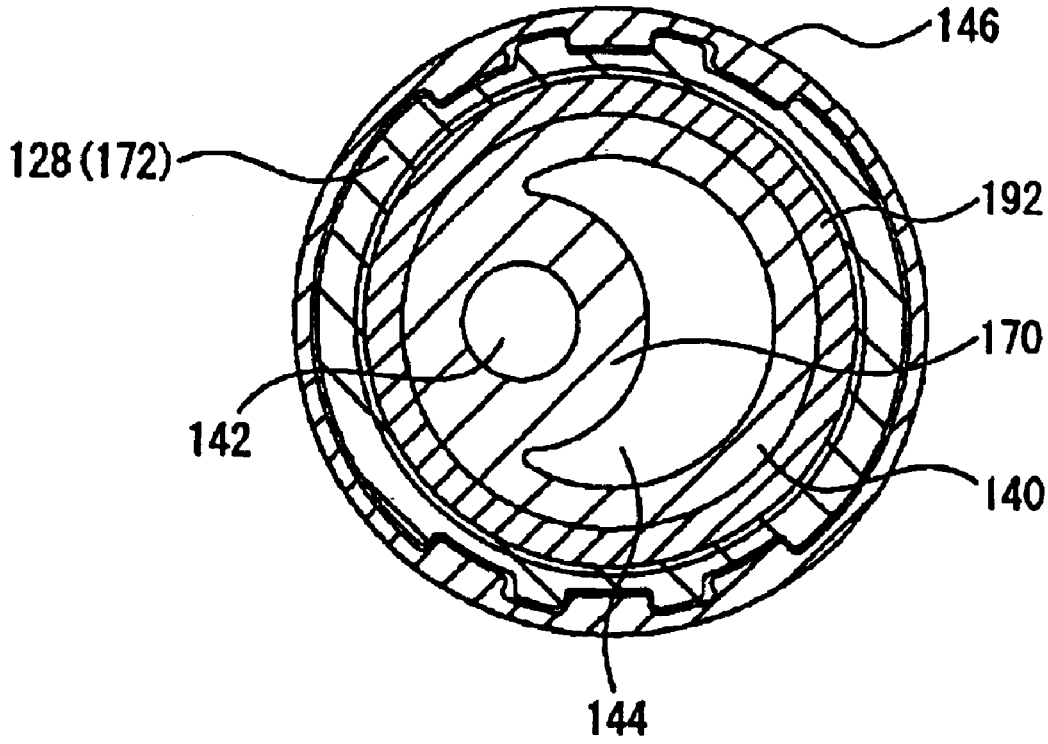
FIG. 11 is a sectional view taken along line XI—XI of FIG. 7.

As will be seen from FIG. 11, the base portion member 140 is generally cylindrically shaped, and has a cylindrical portion 170 which extends in the direction of the axis of the base portion member 140. The cylindrical portion 170 has a bore which forms the air inlet passage 142. An outer surface of the cylindrical portion 170 and an inner surface of the base portion member 140 defines a space which extends axially thereof, and which forms the air outlet passage 144.

The rotor housing 128 of the air motor 112 has a cylindrical joint 172 which extends rearward, and rotatably and hermetically receives a front end portion of the base portion member 140 about longitudinal axis. In the cylindrical joint 172, there is formed a rearward facing surface 174 (forming a right angle with the longitudinal axis) facing a front end of the base portion member 140. Both the first and the second openings 124, 126 extend from the rotor chamber to the rear end surface of the cylindrical joint 172.

The air inlet passage 142 of the base portion member 140 is provided with a larger diameter portion 180 and a smaller diameter portion 182, in that order, from a front end thereof adjacent to the rearward facing surface 174 of the rotor housing 128. In the larger diameter portion 180, there are provided a cylindrical seal 184 movable in a forward and a rearward direction, and a coil spring which urges the cylindrical seal against the rearward facing surface 174. A front end surface of the cylindrical seal 184 is hermetically and slidably engaged with the rearward facing surface 174 of the rotor housing 128.

Figure 12:
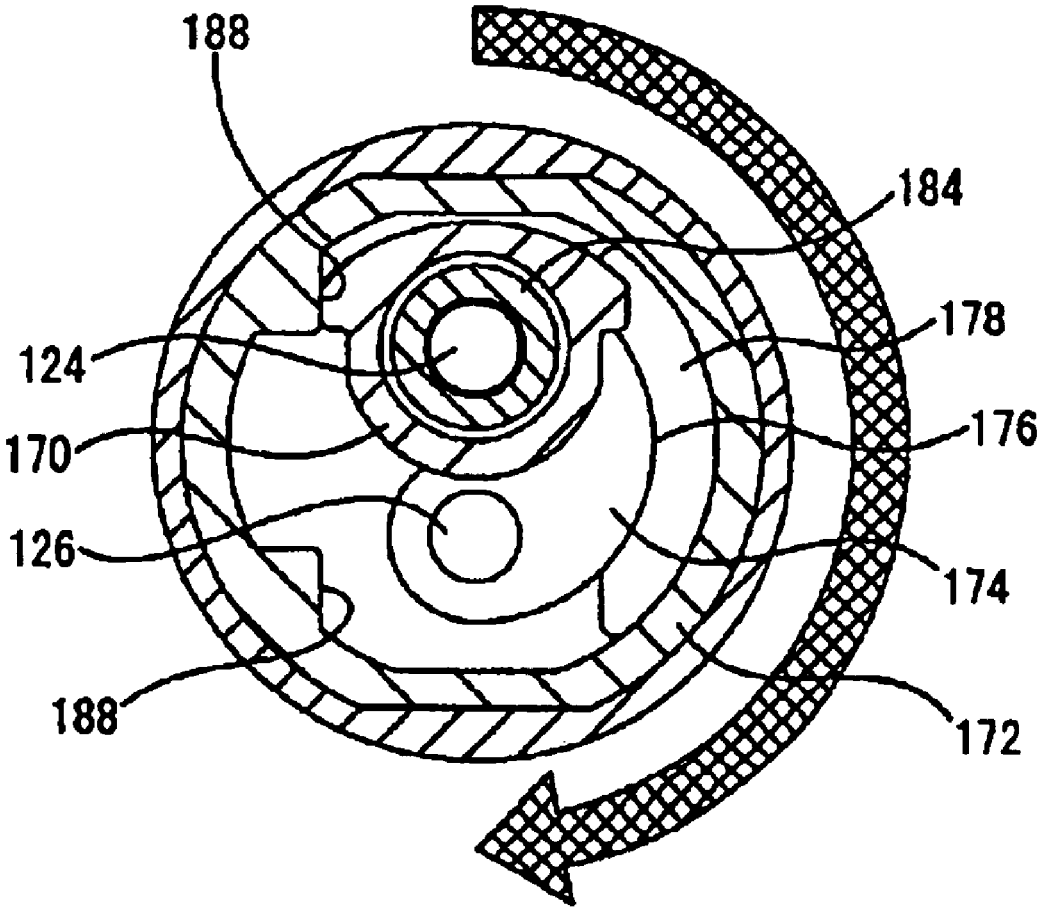
FIG. 12 is a sectional view taken along line XII—XII of FIG. 10.
Figure 13:
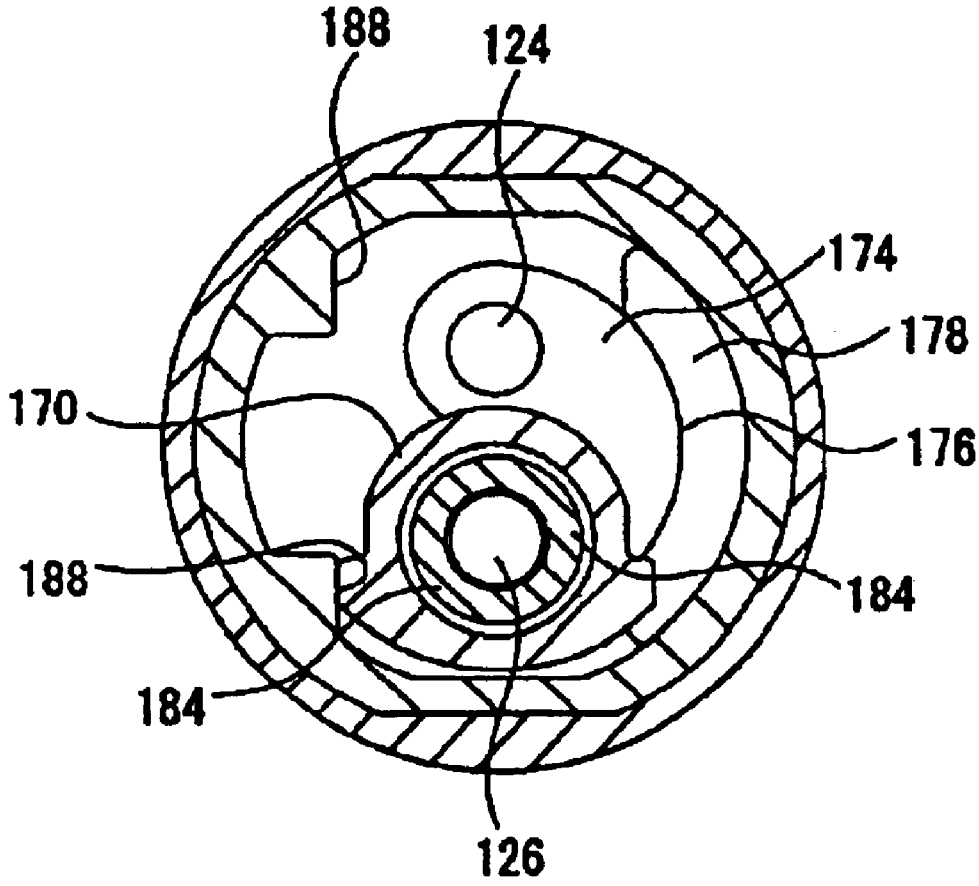
FIG. 13 is a sectional view similar to that of FIG. 12, but shows a base portion of the machine rotated by 180° relative to its position shown in FIG. 12.

Further, in the illustrated example, the cylindrical portion 170 forming the air inlet passage 142 projects beyond the front end surface of the base portion member 140. The rearward facing surface 174 has a semi-circular form (FIGS. 12, 13) delineating a path along which the front end of the cylindrical portion 170 is moved when the base portion is turned between the first and second positions relative to the main portion. The rearward facing surface 174 is defined by a rear end surface of a columnar potion 176 which axially extends inside the cylindrical joint 172, and has a semi-circular cross section. The first air passage 124 and the second air passage 126 are formed to extend through the columnar portion 176 in a forward and rearward direction, and are arranged to open through the rearward facing surface at diametrically opposite positions on a circular area on the surface having a center, through which an axis for rotation of the base portion member 140 extends. Moreover, a second outlet passage is defined between an inner surface of the cylindrical joint 172 and an outer surface of the columnar portion 176, and allows exhaust air to flow from the rotor chamber 122 to the air outlet passage 144 in the base portion member 140. As shown in FIG. 12 and FIG. 13, there are provided a pair of stop portion 188, 188 which are engaged with a distal end of the cylindrical portion 170 having the air inlet passage 142 to prevent excess rotation of the base portion member 140, when the base portion member 140 is rotated to either the first position or the second position.

In FIG. 8*a* the numeral 190 denotes a pipe for communicating an air inlet (not shown) of the base portion member 140 to a pump. The numeral 192 is an installation sleeve for installing the lock sleeve 146 and the coil spring 149 on the base portion member 140. The tension bar 134 shown in FIG. 8*b* is provided with an idle roller 196 at its midpoint via a bracket 194. The bracket 194 is adapted to be detached from one side of the tension bar 134 and to be transferred to another side (upper side) to enable the abrading belt to be adjusted in response to the positional change of the main portion 116 relative to the base portion member, as described above.

The endless belt abrading machine 110 according to the second embodiment of the present invention has the arrangement described above. When an operator operates the machine 110 holding it with his/her right hand, the operator holds the base portion member 140 having the arrangement shown in FIGS. 7, 8*a*, such that the abrading belt 114 is located to the left side relative to the base portion member 140, and accordingly is positioned forward and to the center of the operator. In a case where the base portion member 140 is set in the first position as shown in FIG. 8*a*, the belt is enabled to be turned in a counterclockwise direction, and in the second position as shown in FIG. 9*a*, the belt is enabled to be turned in a clockwise direction. In addition, when an operator operates the machine 110 with holding it with his/her left hand, the main portion 116 is turned through 180° relative to the base portion member from the position shown in FIG. 7, whereby the main portion 116 is located to the right side of the base portion member 140 held by operator's left hand forward and to the center of the operator. When the base portion member 140 is set to either the first position or the second position as desired by an operator, the belt is enabled to be turned in a desired direction.

It should be noted that the present invention is not limited to the foregoing embodiments, and can be modified in a variety of ways without departing from the gist of the present invention.

It is therefore intended that the foregoing detailed description be regarded as illustrative rather than limiting, and that it be understood that it is the following claims, including all equivalents, that are intended to define the spirit and scope of this invention.

What is claimed is:

1. A hand-held endless belt abrading machine comprising:

a main portion including:

an air motor having a rotational shaft extending in a direction transverse to said abrading machine and projecting from one lateral end of said air motor, a drive pulley drivingly connected to a tip end of said output shaft of air motor, a driven pulley positioned forward of and spaced apart from said drive pulley, and an abrading endless belt engaged with and extending between said drive and driven pulleys; and a base portion connected to a rear of said main portion and including:

a first air passageway connected to a source of compressed air for supplying compressed air to said main portion so as to drive said air motor, a stop valve adapted to open and close said first air passageway, and a valve controller, which operates said stop valve, provided at a predetermined position on an outer peripheral surface of said base portion;

wherein said main portion is pivotable about an axis, which extends in a forward and rearward direction of said abrading machine, between a first operational position where said output shaft of said air motor is extended to the left and a second operational position where said output shaft is extended to the right.

2. An endless belt abrading machine according to claim 1, wherein said valve controller is adapted to be moved between a depressed position where said valve controller is depressed and an release position where said valve controller is not depressed for operating said stop valve.

3. An endless belt abrading machine according to claim 1, wherein said air motor has first and second openings adapted to be selectively supplied with compressed air depending on whether it is desired to rotate said motor in a forward or rearward direction; and, said main portion includes a second passageway which comprises a common passage having an air inlet communicated with said first air passageway, and first and second branched passages respectively extending to said first and said second openings of said air motor, and, a ring valve provided on an outer surface of said main portion between a first position where said common passage is brought into communication with said first branched passage, and a second position where said common passage is brought into communication with said second branched passage.

4. An endless belt abrading machine according to claim 2, wherein said air motor has first and second openings adapted to be selectively supplied with compressed air depending on whether it is desired to rotate said motor in a forward or rearward direction; and, said main portion having a second passageway which comprises a common passage having an air inlet communicated with said first air passageway, and first and second branched passages respectively extending to said first and said second openings of said air motor, and, a ring valve provided on an outer surface of said main portion between a first position where said common passage is brought into communication with said first branched passage, and a second position where said common passage is brought into communication with said second branched passage.

5. An endless belt abrading machine according to claim 3, wherein said main portion has a columnar portion extending in said forward and rearward direction and having a circular cross-section;

said columnar portion is provided with said second air passageway thereof such that said common passage extends from said air inlet to an air outlet formed in an outer circumferential surface of the columnar portion, said first branched passage extends from a first inlet/outlet opening formed in said outer circumferential surface at a position circumferentially spaced apart from said air outlet to said first opening of said air motor, and said second branched passage extends from a second inlet/outlet opening formed in the same surface at a position circumferentially spaced apart from said air outlet and said first inlet/outlet opening; and, said ring valve is mounted on said outer circumferential surface of said columnar portion and is rotatable between a first position where said air outlet is communicated with said first inlet/outlet opening and a second position where said air outlet is communicated with said second inlet/outlet opening.

6. An endless belt abrading machine according to claim 4, wherein said main portion has a columnar portion extending in said forward and rearward direction and having a circular cross-section;

said columnar portion is provided with said second air passageway thereof such that said common passage extends from said air inlet to an air outlet formed in an outer circumferential surface of the columnar portion, said first Branched passage extends from a first inlet/outlet opening formed in said outer circumferential surface at a position circumferentially spaced apart from said air outlet to said first opening of said air motor, and said second branched passage extends from a second inlet/outlet opening formed in the same surface at a position circumferentially spaced apart from said air outlet and said first inlet/outlet opening; and, said ring valve is mounted on said outer circumferential surface of said columnar portion and is rotatable between a first position where said air outlet is communicated with said first inlet/outlet opening and a second position where said air outlet is communicated with said second inlet/outlet opening.

7. A hand-held endless belt abrading machine comprising:

a main portion including:

an air motor having a rotational shaft extending in a direction transverse to said abrading machine and projecting from one lateral end of said air motor, said air motor further having first and second openings adapted to be selectively supplied with compressed air depending on whether it is desired to rotate said motor in a forward or rearward direction, a drive pulley drivingly connected to a tip end of said output shaft of air motor, a driven pulley positioned forward of and spaced apart from said drive pulley, and an abrading endless belt engaged with and extended between said drive and driven pulleys; and a base portion connected to a rear of said main portion and including:

an air inlet passage for supplying compressed air to said air motor, an air outlet passage for discharging air exhausted from said air motor to the outside of said machine, a stop valve for opening and closing said air inlet passage, said stop valve having an outer end projecting outside said base portion, and a lever for operating said stop valve, said lever being pivotably mounted on said base portion to move between an opening position where said stop valve opens said air inlet passage and a closing position where said stop valve closes said air inlet passage, wherein said main portion is pivotable about an axis, which extends in a forward and rearward direction of said abrading machine, between a first operational position where said output shaft of said air motor is extended to the left and a second operational position where said output shaft is extended to the right, wherein when said main portion is located in said first operational position, said air inlet passage of said base portion is communicated with said first opening while said air outlet passage is simultaneously communicated with said second opening of said motor, and when said main portion is located in said second operational position, said air inlet passage is communicated with said second opening while said air outlet passage is simultaneously communicated with said first opening.

8. An endless belt abrading machine according to claim 7, wherein said main portion includes a sleeve mounted on said main portion such that the sleeve is movable in a longitudinal direction of said main portion between a rotation-prevention position, where said sleeve is engaged with said base portion to prevent said main portion from rotating relative to said base portion, and a rotation-enabling position where said sleeve is disengaged from said base portion to permit said main portion to rotate relative to said base portion.

9. An endless belt abrading machine according to claim 7, wherein said main portion includes a rearward facing surface which faces said base portion and forms a right angle with an axis extending in said forward and rearward direction, and first and second air passages open at positions which are diametrically opposite each other on a circle on said rearward facing surface centering around an axis extending in the forward and rearward direction through said base portion, said first and second air passages being communicated with said first opening and said second opening of said motor, respectively;

and said air inlet passage of said base portion includes a larger diameter portion and a smaller diameter portion arranged in that order from a front end thereof adjacent to said rearward facing surface of said main portion, said larger diameter portion being provided with a cylindrical seal movable in the forward and rearward direction and a coil spring which urges said cylindrical seal against said rearward facing surface; and, said cylindrical seal has a front end slidably and hermetically engageable with said rearward facing surface of said main portion, wherein when said main portion is located in said first operational position, said cylindrical seal is communicated with said first air passage; and when said main portion is in said second operational position, said cylindrical seal is communicated with said second air passage.

10. An endless belt abrading machine according to claim 8, wherein said main portion includes a rearward facing surface which faces said base portion and makes a right angle with an axis extending in said forward and rearward direction, and first and second air passages open at positions which are diametrically opposite each other on a circle on said rearward facing surface centering around an axis extending in the forward and rearward direction through said base portion, said first and second air passages being communicated with said first opening and said second opening of said motor, respectively;

said air inlet passage of said base portion includes a larger diameter portion and a smaller diameter portion arranged in that order from a front end thereof adjacent to said rearward facing surface of said main portion, said larger diameter portion being provided with a cylindrical seal movable in the forward and rearward direction and a coil spring which urges said cylindrical seal against said rearward facing surface; and, said cylindrical seal has a front end slidably and hermetically engageable with said rearward facing surface of said main portion, wherein when said main portion is located in said first operational position, said cylindrical seal is communicated with said first air passage; and when said main portion is in said second operational position, said cylindrical seal is communicated with said second air passage.

11. An endless belt abrading machine according to claim 10, wherein said lock sleeve includes a notch which is formed in a rear end periphery thereof such that, when said sleeve is located in said rotation-prevention position, said notch engages with a pin secured on an outer circumferential surface of said base portion to prevent said main portion from rotating relative to said base portion.

12. An endless belt abrading machine according to claim 10, wherein said base portion comprises an outer cylindrical portion and an inner cylindrical portion disposed in said outer cylindrical portion which extend in the forward and rearward direction of said machine, said inner cylindrical portion has a longitudinal hole which forms said air inlet passage, a space extending in a longitudinal direction of the inner and outer cylindrical portions is formed between an outer surface of said inner cylindrical portion and an inner surface of said outer cylindrical portion, said space functioning as said air outlet passage.

13. An endless belt abrading machine according to claim 12, wherein said inner cylindrical portion of said base portion has a forward end extending beyond a front end of said outer cylindrical portion of said base portion, said main portion includes a cylindrical joint, which extends rearward to hermetically receive said forward end of said base portion such that said base portion is rotatable about a longitudinal axis thereof while maintaining an air-tight state between said cylindrical joint and said forward end of said base portion, and a columnar portion which has said first and second air passages and is positioned inside and extends rearward of said main portion member terminating at said rearward facing surface, and an air outlet passage is formed between an inner surface of said cylindrical joint of said main portion and said outer surface of said columnar portion of said main portion, said air outlet passage extending from said air motor.

14. An endless belt abrading machine according to claim 13, wherein an inner surface of said cylindrical joint of said main member are provided with a pair of stop portions which are adapted to be engaged with the forward end of said cylindrical portion defining said air inlet passage to position said main portion at said first and second operational positions, respectively.

* * * * *